US009693410B2

(12) United States Patent
Holtman et al.

(10) Patent No.: US 9,693,410 B2
(45) Date of Patent: Jun. 27, 2017

(54) METHODS AND DEVICES FOR PROJECTION OF LIGHTING EFFECTS CARRYING INFORMATION

(71) Applicant: PHILIPS LIGHTING HOLDING B.V., Eindhoven (NL)

(72) Inventors: Koen Johanna Guillaume Holtman, Eindhoven (NL); Robert James Davies, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/027,128

(22) PCT Filed: Sep. 19, 2014

(86) PCT No.: PCT/IB2014/064652

§ 371 (c)(1),
(2) Date: Apr. 4, 2016

(87) PCT Pub. No.: WO2015/049614

PCT Pub. Date: Apr. 9, 2015

(65) Prior Publication Data

US 2016/0249426 A1 Aug. 25, 2016

Related U.S. Application Data

(60) Provisional application No. 61/886,808, filed on Oct. 4, 2013.

(51) Int. Cl.

| | |
|---|---|
| ***H05B 33/00*** | (2006.01) |
| ***H05B 33/08*** | (2006.01) |
| ***H05B 37/02*** | (2006.01) |

(52) U.S. Cl.

CPC ..... *H05B 33/0845* (2013.01); *H05B 33/0857* (2013.01); *H05B 33/0896* (2013.01); *H05B 37/0272* (2013.01)

(58) Field of Classification Search

CPC ..... F21V 23/0485; F21V 33/006; F21V 23/0442; F21V 23/0471; E04B 9/32;

(Continued)

(56) References Cited

U.S. PATENT DOCUMENTS

2007/0195270 A1 8/2007 Hull et al.
2008/0055246 A1 3/2008 Okayama et al.

(Continued)

FOREIGN PATENT DOCUMENTS

JP H08125614 A 5/1996
JP 2006352562 A 12/2006

(Continued)

OTHER PUBLICATIONS

Borogovac, Tarik, et al., "Spotlighting for Visible Light Communications and Illumination," Dept. of Electrical and Computing Engineering, Smart Lighting Engineering Research Center, Boston University, Boston, MA (2014) (5 Pages).

*Primary Examiner* — Monica C King
(74) *Attorney, Agent, or Firm* — Meenakshy Chakravorty

(57) ABSTRACT

Methods, apparatus, and systems are disclosed herein for projecting lighting effects (124, 224, 324, 424) carrying light messages onto surfaces. A first of one or more light-emitting diodes (LEDs, 554) of a lighting fixture (120, 220, 320, 420, 520) may be selectively energized to produce a first coded light signal conveying a first light message associable with a first location. Light emitted from the first LED may be projected onto a first surface, e.g., as a spatially-limited lighting effect. In some embodiments, a second of the one or more LEDs of the lighting fixture may be selectively energized to produce a second coded light signal conveying a second light message associable with a second location distinct from the first location. Light emitted from the second LED may be projected onto the first surface or a (Continued)

second surface. Alternatively, lighting effects of various shapes and hues may convey information.

20 Claims, 6 Drawing Sheets

(58) Field of Classification Search
CPC ... E04B 5/46; H05B 33/0845; H05B 33/0857; H05B 33/0896; H05B 37/0272
See application file for complete search history.

(56) References Cited

U.S. PATENT DOCUMENTS

| | | | | |
|---|---|---|---|---|
| 2010/0296285 | A1* | 11/2010 | Chemel ..... | F21S 2/005 362/235 |
| 2010/0329691 | A1 | 12/2010 | Schenk et al. | |
| 2011/0076024 | A1 | 3/2011 | Damink | |
| 2013/0088155 | A1 | 4/2013 | Maxik et al. | |
| 2013/0141554 | A1 | 6/2013 | Ganick et al. | |

FOREIGN PATENT DOCUMENTS

| | | | |
|---|---|---|---|
| JP | 2008210712 | A | 9/2008 |
| JP | 2011244141 | A | 12/2011 |

* cited by examiner

METHODS AND DEVICES FOR PROJECTION OF LIGHTING EFFECTS CARRYING INFORMATION

CROSS-REFERENCE TO PRIOR APPLICATIONS

This application is the U.S. National Phase application under 35 U.S.C. §371 of International Application No. PCT/IB2014/064652, filed on Sep. 19, 2014, which claims the benefit of U.S. Provisional Patent Application No. 61/886,808, filed on Oct. 4, 2013. These applications are hereby incorporated by reference herein.

TECHNICAL FIELD

The present invention is directed generally to projection of lighting effects that carry information. More particularly, various inventive methods, systems, apparatus and lighting fixtures disclosed herein relate to projecting, by a lighting fixture, light selectively emitted from one or more LEDs onto one or more surfaces to create one or more lighting effects that convey information.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications.

A plurality of LED-based lighting units may be installed in a location such as a store or airport. Each LED-based lighting unit may be illuminated to emit light that conveys a coded light signal carrying data associable with a location (e.g., coordinates within a store, "Aisle 3," etc.). These coded light signals may be detected by light sensors (e.g., cameras) of mobile computing devices such as smart phones, which may use the location data for various purposes, such as navigating a shopper through a store. However, viewing angles of smart phone cameras may be small. Without deploying numerous LED-based lighting units, a smart phone may not always be able to detect one of the LED-based lighting units. Further, replacing existing lighting installations with LED-based lighting units configured to emit coded light signals may require significant investment. Moreover, unless the plurality of LED-based lighting units are centrally-controlled, it may be labor intensive and/or time consuming to alter coded light signals emitted by the plurality of LED-based lighting units. Thus, there is a need in the art for a more economical, simpler and more easily controllable way to provide locational data by way of emission of one or more coded light signals.

SUMMARY

The present invention is directed generally to projection of lighting effects carrying information. For example, various inventive methods, systems, apparatus and lighting fixtures are related to selective illumination of one or more light-emitting diodes (LEDs) of a lighting fixture to emit one or more coded light signals, and to projection, by the lighting fixture, of light emitted from the one or more LEDs onto one or more surfaces to create one or more lighting effects, wherein the one or more lighting effects convey one or more distinct items of information. In some cases, the lighting effects may be spatially-limited.

In one aspect, the invention relates to a lighting fixture including one or more light-emitting diodes configured to project one or more spatially-limited lighting effects on a surface, when energized. The lighting fixture may also include a controller operably coupled to the one or more LEDs and configured to selectively energize the one or more LEDs to cause the one or more projected lighting effects to convey one or more distinct light messages, wherein at least one of the one or more projected lighting effects carries a coded light signal.

In various embodiments, the one or more distinct light messages are conveyed at least in part by a plurality of distinct coded light signals carried by the one or more projected lighting effects. In various embodiments, the one or more distinct light messages are conveyed at least in part by a plurality of distinct hues of the one or more projected lighting effects. In various embodiments, the one or more distinct light messages are conveyed at least in part by a plurality of distinct shapes of the one or more lighting effects.

In various embodiments, the lighting fixture may include one or more optical elements shaped to direct light emitted by the one or more LEDs onto one or more surfaces. In various versions, the one or more optical elements are integral with an injection-molded cover plate. In various versions, at least one of the one or more optical elements is configured to shape light emitted from at least one of the one or more LEDs into an asymmetrically-shaped projected light effect. In various versions, the one or more optical elements are shaped to direct light emitted by the one or more LEDs so that the one or more projected lighting effects are positioned to correspond with a plurality of aisles.

In various embodiments, the lighting fixture includes a mask with one or more shaped apertures configured to define shapes of the one or more lighting effects. In various versions, the one or more shaped apertures are configured to define a plurality of distinct shapes of the one or more lighting effects. In various versions, at least one of the one or more shaped apertures is configured to define light emitted from at least one of the one or more LEDs into an asymmetric shape.

In various embodiments, the lighting fixture may include a general-purpose light source configured to illuminate a space proximate the lighting fixture.

In various embodiments, the lighting fixture may include a housing, wherein the one or more LEDs and the controller are enclosed within the housing, wherein the housing is configured to be mounted on a wall or ceiling.

In various embodiments, the one or more LEDs are configured to project the one or more lighting effects with an intensity selected to make the one or more lighting effects substantially imperceptible to a human and detectable by an optical sensor of a mobile computing device.

In various embodiments, the one or more distinct light messages are associable with a plurality of distinct locations.

In another aspect, the invention relates to a method that includes: selectively energizing, by a controller of a lighting fixture, a first of a plurality of light-emitting diodes of the lighting fixture to produce a first coded light signal that conveys a first light message associable with a first location; projecting, by the lighting fixture, light emitted from the first LED onto a first surface; selectively illuminating, by the controller, a second of the plurality of LEDs of the lighting fixture to produce a second coded light signal that conveys a second light message associable with a second location distinct from the first location; and projecting, by the lighting fixture, light emitted from the second LED onto the first surface or a second surface.

In various embodiments, projecting the light emitted from the first LED comprises projecting the light emitted from the first LED onto a portion of a ceiling above a first aisle, and wherein projecting the light emitted from the second LED comprises projecting the light emitted from the second LED onto a portion of the ceiling above a second aisle. In various embodiments, projecting the light emitted from the first LED comprises projecting the light emitted from the first LED onto a floor of a first aisle. In various versions, projecting the light emitted from the second LED comprises projecting the light emitted from the second LED onto a floor of a second aisle. In various embodiments, projecting the light emitted from the second LED comprises projecting the light emitted from the second LED onto a shelf of a second aisle.

In another aspect, a lighting fixture may include a housing; first and second light-emitting diode contained within the housing; first and second optical elements mounted on the housing and configured to direct light emitted from the first and second LEDs onto one or more surfaces; and a controller operably coupled to the first and second LEDs and configured to: illuminate the first LED to produce a first coded light signal that conveys a first light message associable with a first location; and illuminate the second LED to produce a second coded light signal that conveys a second light message associable with a second location distinct from the first location.

In various embodiments, the lighting fixture may include a mask with first and second shaped apertures configured to define shapes of first and second projected lighting effects created by the first and second LEDs, respectively. In various versions, the first and second shaped apertures are configured to define first and second distinct shapes of the first and second projected lighting effects. In various embodiments, at least one of the first and second shaped apertures is configured to define light emitted from at least one of the first and second LEDs into an asymmetric shape.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers).

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

The term "light source" should be understood to refer to any one or more of a variety of radiation sources, including, but not limited to, LED-based sources (including one or more LEDs as defined above). A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "coded light signal" may refer to light waves that are selectively emitted (e.g., modulated) to have various properties that convey information. A light sensor may be a device such as a camera that may receive the coded light signal. A received coded light signal may be demodulated to extract the conveyed information.

As used herein, "selective illumination," "selectively illuminating," and other similar terms may refer to causing one or more light sources to emit light with one or more selected properties. These properties may include but are not limited to a selected hue, saturation, brightness, animation, temperature, carried signal (e.g., coded light signals), and so forth.

As used herein, "spatially-limited," when referring to lighting effects, means that the projected lighting effect on the surface is not ambient, and instead has a limited area that is controlled by one or more components of a lighting fixture, such as an optical element, a shaped aperture, one or more lenses, a light source itself, and so forth. In some cases, a spatially-limited lighting effect may have boundaries that are perceptible to a human. In other cases, a spatially-limited lighting effect may not be perceptible to human, but may be perceptible to an optical sensor (e.g., a camera), e.g., if the emitted light is very dim, colored similarly to the underlying surface, or in the infrared spectrum.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

A plurality of LED-based lighting units may be installed in a location such as a store or airport. Each LED-based lighting unit may be illuminated to emit light that conveys a coded light signal carrying data associable with a location (e.g., coordinates within a store, "Aisle 3," etc.). These coded light signals may be detected by light sensors (e.g., cameras) of mobile computing devices such as smart phones, which may use the location data for various purposes, such as navigating a shopper through a store. However, viewing angles of smart phone cameras may be small, such that without deploying numerous LED-based lighting units, a smart phone may not always be able to detect one of the LED-based lighting units. Replacing existing lighting installations with LED-based lighting units that emit coded light signals may require significant investment. Moreover, it may be labor intensive and/or time consuming to alter coded light signals emitted by a plurality of separate LED-based lighting units. Thus, Applicants have recognized and appreciated that it would be beneficial to provide a more economical way to use coded light signals to provide locational data that is also simple and/or convenient to control.

In view of the foregoing, various embodiments and implementations of the present invention are directed to projection of lighting effects carrying information. More particularly, various inventive methods, systems, apparatus and lighting fixtures disclosed herein relate to selectively illuminating one or more LEDs of a lighting fixture to emit one or more coded light signals, and projecting, by the lighting fixture, light emitted from the one or more LEDs onto one or more surfaces to create one or more projected lighting effects that convey one or more distinct light messages. In some embodiments, one or more components of a lighting fixture may be configured to cause light emitted by the one or more LEDs to project lighting effects that are spatially-limited.

Figure 1:
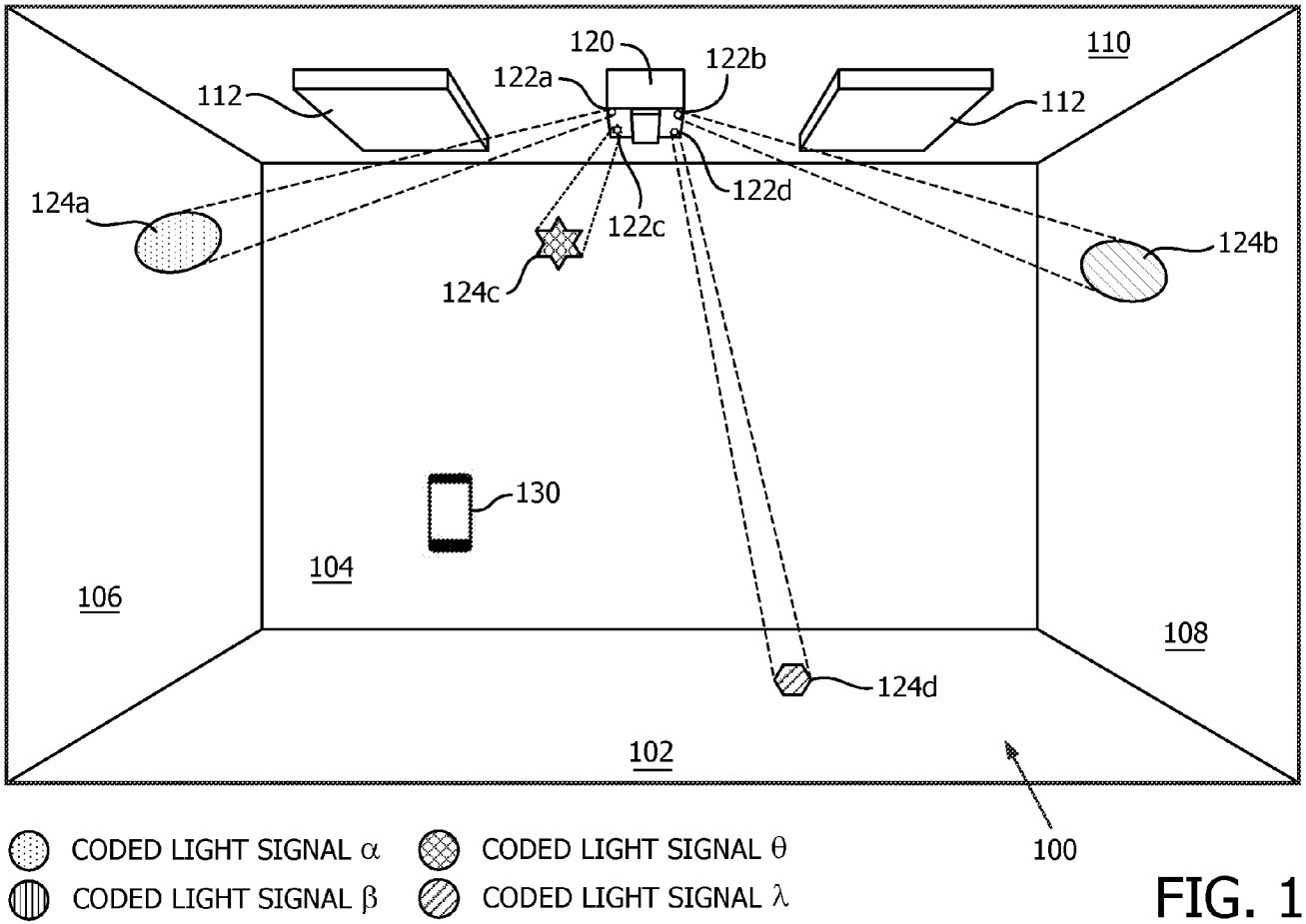
FIG. 1 illustrates one example of how a lighting fixture configured with selected aspects of the present disclosure may be operated in a room, in accordance with various embodiments.

Referring to FIG. 1, an example room 100 may include multiple surfaces, including a floor 102, a first wall 104, a second wall 106, a third wall 108, and a ceiling 110. A room may include more or less surfaces; room 100 is provided for illustrative purposes only. Room 100 may be illuminated by one or more standard lighting fixtures 112, although this is not required.

A lighting fixture 120 configured with selected aspects of the present disclosure is shown mounted on ceiling 110. Lighting fixture 120 may include a plurality of optical elements 122*a-d*. In various embodiments, lighting fixture 120 may include more or less optical elements. In various embodiments, one or more of plurality of optical elements 122*a-d* may be shaped (e.g., as a diffusing lens) to direct light emitted from one or more LEDs (not shown in FIG. 1) contained in lighting fixture 120 onto a surface. Thus, collectively, plurality of optical elements 122*a-d* may project a plurality of projected lighting effects 124*a-d* onto one or more surfaces of room 100. In various embodiments, optical elements 122*a-d* may be constructed with various transparent or translucent materials, such as plastic, glass, and so forth. In various embodiments, and as depicted generally in the drawings, the projected lighting effects may be spatially-limited.

In the non-limiting example of FIG. 1, a first optical element 122*a* projects a first lighting effect 124*a* onto second wall 106. A second optical element 122*b* projects a second lighting effect 124*b* onto third wall 108. A third optical element 122*c* projects a third lighting effect 124*c* onto first wall 104. A fourth optical element 122*d* projects a fourth lighting effect 124*d* onto floor 102. Each of these projected lighting effects 124*a-d* may convey a lighting message that is associable, e.g., by a mobile device such as a smart phone 130, with a particular location. For instance, if a light sensor (e.g., camera) on smart phone 130 "sees" first lighting effect 124*a*, smart phone 130 may determine that a user of smart phone 130 is standing near second wall 106. In some embodiments, smart phone 130 may detect more than one of plurality of projected lighting effects 124*a-d*. Smart phone may use triangulation or other techniques to determine its location with more accuracy than might be possible from detecting a single projected lighting effect.

One projected lighting effect produced in accordance with the present disclosure may be distinguished from another in various ways. In some embodiments, each projected lighting effect may convey a distinct coded light signal. For instance, a first LED (not shown in FIG. 1) may be selectively energized by a controller (not shown in FIG. 1) of lighting fixture 120 to emit light that carries a coded light signal $\alpha$ through first optical element 122*a*, so that first lighting effect 124*a* also carries the coded light signal $\alpha$. A second LED (not shown in FIG. 1) may be selectively energized by the controller to emit light that carries a coded light signal $\beta$ through second optical element 122*b*, so that second lighting effect 124*b* also carries the coded light signal $\alpha$. A third LED (not shown in FIG. 1) may be selectively energized by the controller to emit light that carries a coded light signal $\theta$ through third optical element 122*c*, so that third lighting effect 124*c* also carries the coded light signal $\theta$. A fourth LED (not shown in FIG. 1) may be selectively energized by the controller to emit light that carries a fourth coded light signal $\lambda$ through fourth optical element 122*d*, so that fourth lighting effect 124*d* also carries the coded light signal $\lambda$.

Coded light signals described herein may carry various types of information that is associable with a location. In some embodiments, a coded light signal may carry a simple identifier, which may be unique globally or within a local setting such as a store. In various embodiments, the identifier may be associable, e.g., by smart phone 130, with a location within a setting. For instance, smart phone 130 may cross-reference an identifier carried by first projected lighting effect 124*a* with a database (in memory of smart phone 130 or available over one or more networks) of identifiers and associated locations.

In other embodiments, a coded light signal may carry more directly-usable location data. For instance, a coded light signal may carry GPS coordinates, which may be used by smart phone 130 in situations in which smart phone 130 is unable to detect a GPS signal, such as inside of a store. As another example, the coded light signal may carry location data pertinent to a particular setting, such as a store. For instance, one or more of projected lighting effects 124*a-d* may carry location-identifying data such as "Men's Formalwear," "Produce Department," "Aisle 3," Cartesian coordinates within a building, Polar coordinates within a building, and so forth.

Another example of how projected lighting effects may be distinguished from one another is by their shapes. For instance, in FIG. 1, first lighting effect 124*a* and second lighting effect 124*b* are generally round, whereas third lighting effect 124*c* is shaped like a star, and fourth lighting effect 124*d* is shaped like a hexagon. Other shapes, both symmetric and asymmetric, may be used in addition to or instead of those depicted in FIG. 1. A benefit of an asymmetrical shape is that it may make it easier to determine a position of smart phone 130 relative to the location of the asymmetric shape, e.g., by analyzing how the asymmetric shape shows up in a camera image of smart phone 130. For example, a mirror symmetric shape looks the same from two different viewing points on opposite sides. An asymmetric shape will look different from these two viewing points, so it creates fewer ambiguities in image analysis.

Yet another example of how projected lighting effects may be distinguished from one another is by their hues. In addition to or instead of a carried coded light signal or a shape, an LED may be selectively energized, e.g., by the aforementioned controller, to be a particular hue associated with a particular location. Smart phone 130 may be configured to associate detected hues with a particular location. For instance, lighting effects projected into a men's department by lighting fixture 120 may be blue, whereas lighting effects projected into a women's department by lighting fixture 120 may be pink.

Figure 2:
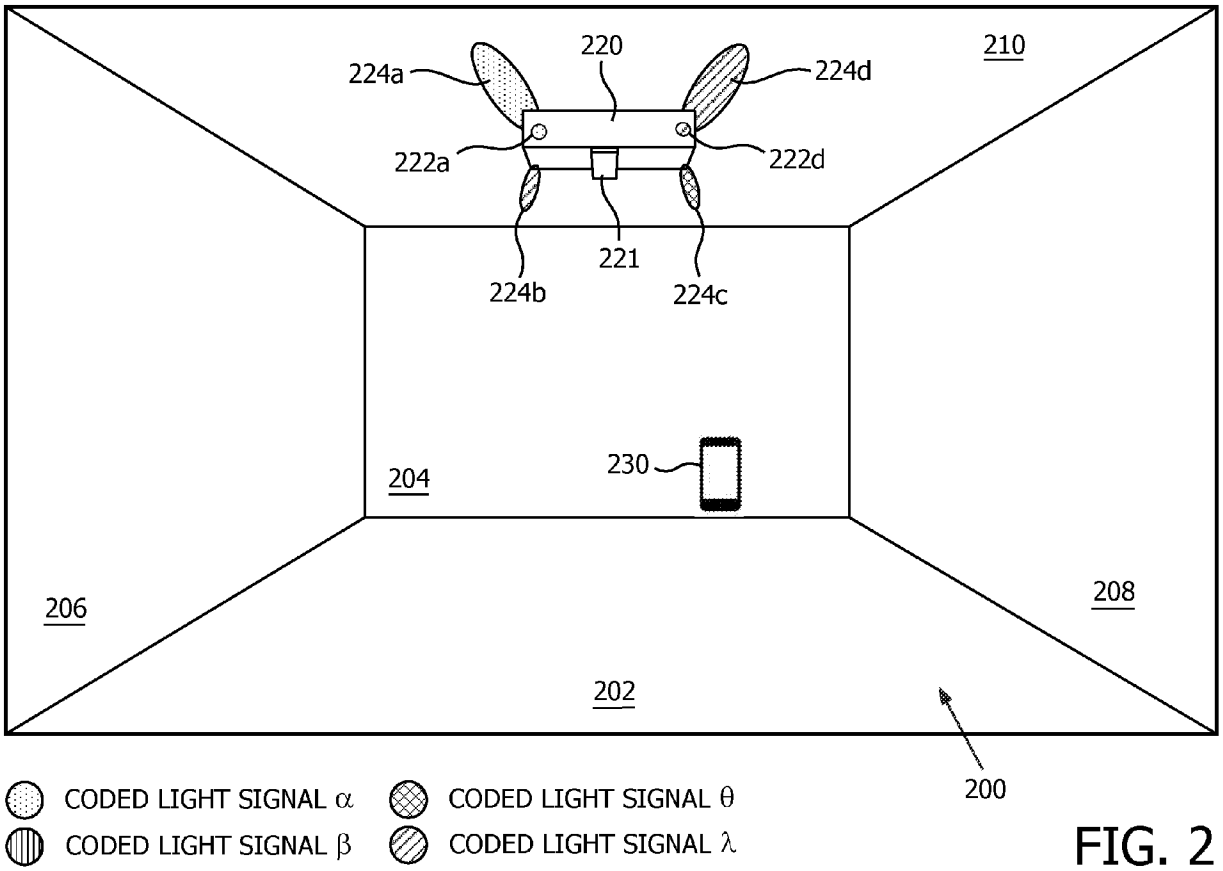
FIG. 2 illustrates another example of how a lighting fixture configured with selected aspects of the present disclosure may be operated in a room, in accordance with various embodiments.

FIG. 2 depicts another example of a room 200, similar to room 100 (and thus similar components are numbered similarly), in which another lighting fixture 220, configured with selected aspects of the present disclosure, is installed. Similar to lighting fixture 120, lighting fixture 220 includes a plurality of optical elements 222*a-d* (only a and d are visible in FIG. 2). In this example, however, instead of projecting lighting effects onto floor 202 and/or walls 204-208, lighting fixture 220 projects lighting effects 224*a-d* onto ceiling 210. When arranged as shown in FIG. 2, each lighting effect 224*a-d* may be projected into a quadrant of room 200. A smart phone 230 in a given quadrant of room 200 may detect the corresponding projected lighting effect, and from a property of that lighting effect (e.g., coded light signal, hue, shape, etc.) may approximate its location within room 200. Lighting fixture 220 in some embodiments may include an integral, general purpose light source 221 separate from optical elements 222*a-d* that illuminates room 200.

Figure 3:
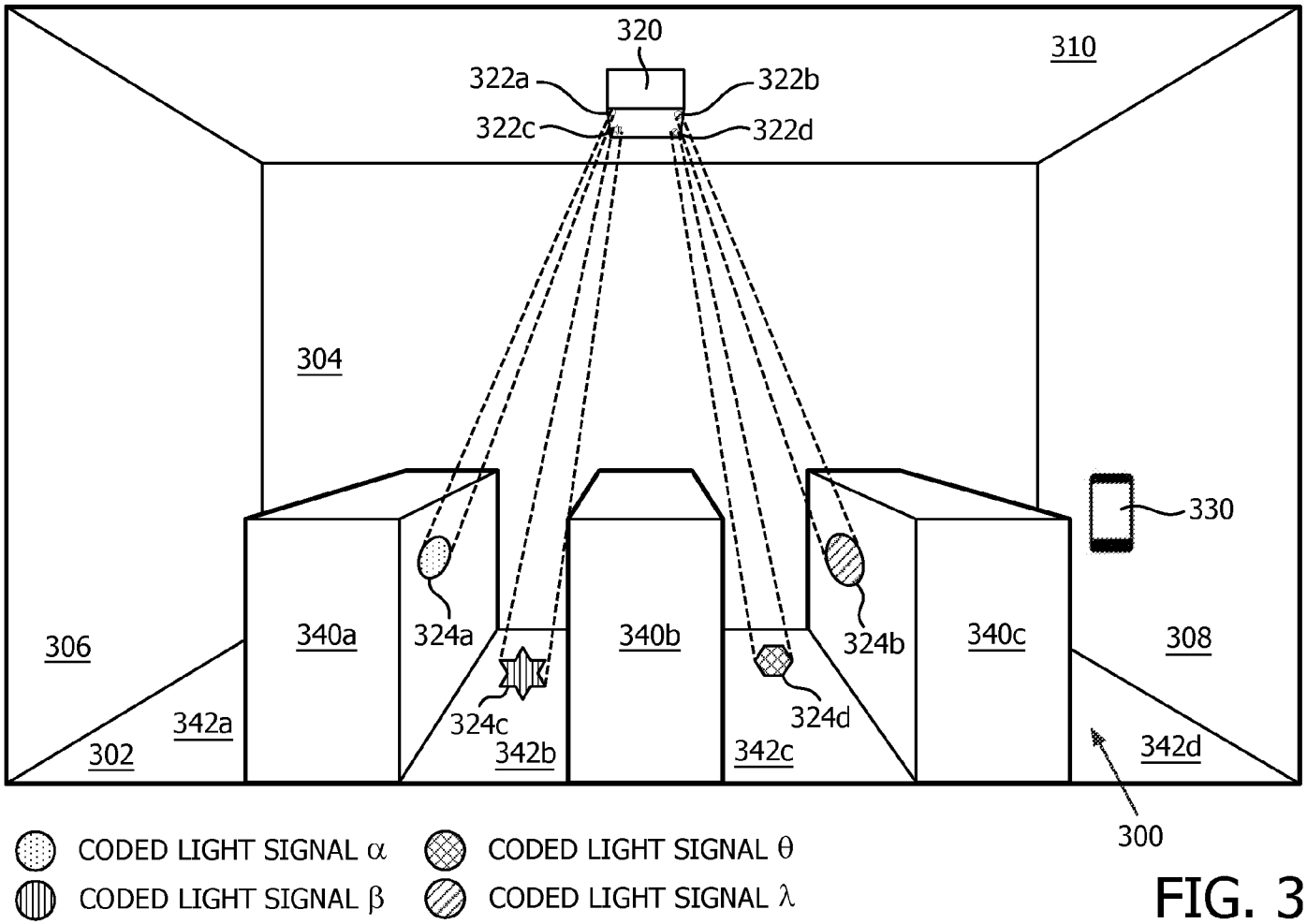
FIG. 3 illustrates another example of how a lighting fixture configured with selected aspects of the present disclosure may be operated in a room, in accordance with various embodiments.

FIG. 3 depicts another example of a room 300 in which a lighting fixture 320 configured with selected aspects of the present disclosure is installed on a ceiling 310. Once again components similar to those of previous figures are numbered similarly. A plurality of shelves 340*a-c* is shown positioned in room 300 to form a plurality of aisles 342*a-d*. Although shown as simple spatial elements for the sake of simplicity, plurality of shelves 340*a-c* may be any type of fixture for selling or displaying products or other items, including but not limited to grocery shelves, shelves for clothes, lines of clothes hanging from hangers, and so forth.

Similar to previously-depicted lighting fixtures, lighting fixture 320 may include a plurality of optical elements 322*a-d* configured to project light emitted from a plurality of LEDs (not shown in FIG. 3) onto one or more surfaces as projected lighting effects 324*a-d*. For instance, in FIG. 3, a first optical element 322*a* projects a coded light signal α in a generally circular-shaped first lighting effect 324*a* onto a side surface of a first shelf 340*a*, within a second aisle 342*b*. A second optical element 322*b* projects a coded light signal λ in a generally circular-shaped second lighting effect 324*b* onto a side surface of a third shelf 340*c*, within a third aisle 342*c*. A third optical element 322*c* projects a coded light signal β in a generally star-shaped third lighting effect 324*c* onto floor 302 within second aisle 342*b*. A fourth optical element 322*d* projects a coded light signal θ in a generally hexagon-shaped fourth lighting effect 324*d* onto floor 302 within third aisle 342*c*. A smart phone 330 carried by a user (not shown) down either of second aisle 342*b* or third aisle 342*c* may be able detect one or more of lighting effects 324*a-d* and determine a location of smart phone 330 relative to plurality of shelves 340*a-c*.

Figure 4:
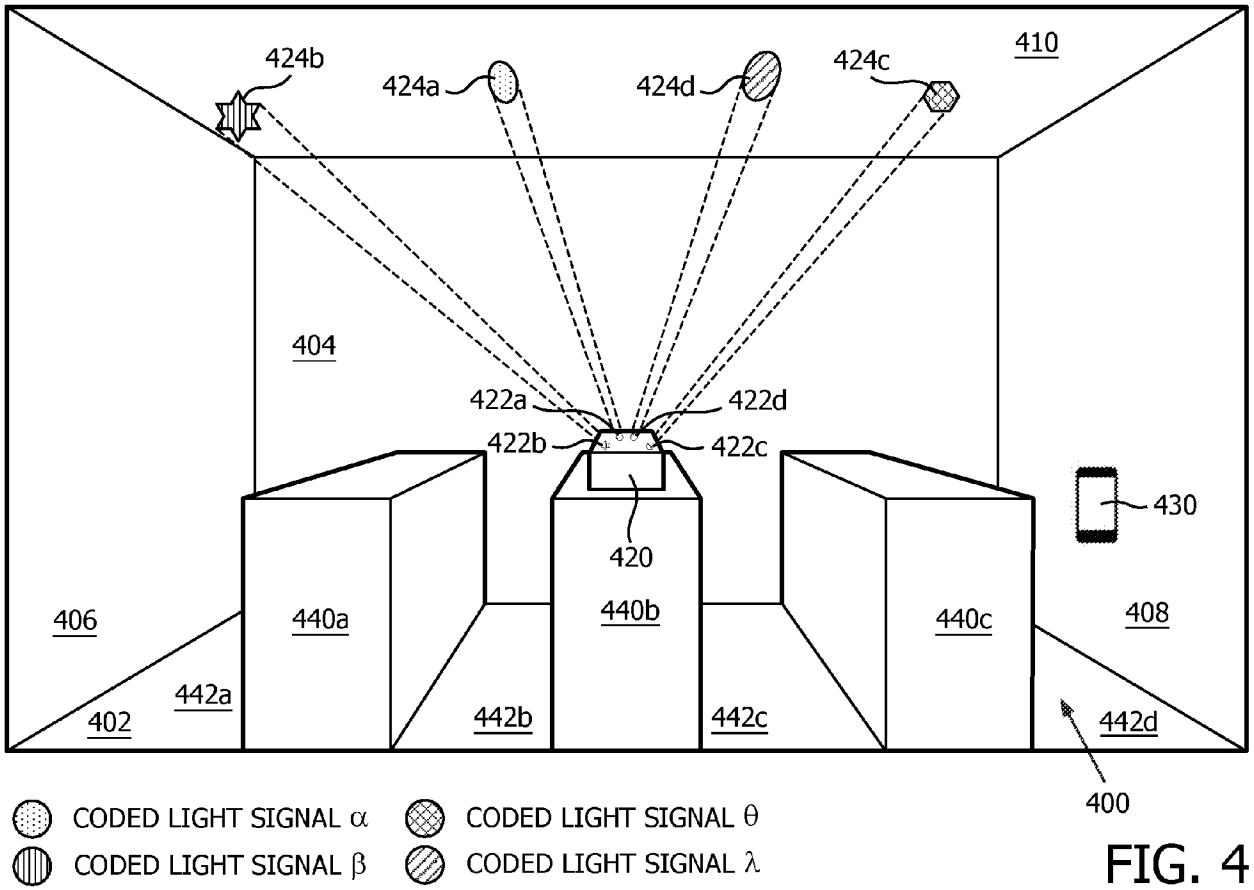
FIG. 4 illustrates another example of how a lighting fixture configured with selected aspects of the present disclosure may be operated in a room, in accordance with various embodiments.

FIG. 4 depicts another example room 400 (with components similar to those in previous figures labeled similarly) in which a lighting fixture 420 configured with selected aspects of the present disclosure is installed on top of one of a plurality of shelves 440*a-c*. A first optical element 422*a* projects a coded light signal α in a generally circular-shaped first lighting effect 424*a* onto a ceiling 410 at a location above a second aisle 442*b*. A second optical element 422*b* projects a coded light signal β in a generally star-shaped second lighting effect 424*b* onto ceiling 410 at a location above a first aisle 442*a*. A third optical element 422*c* projects a coded light signal θ in a generally hexagon-shaped third lighting effect 424*c* onto ceiling 410 at a location above a fourth aisle 442*d*. A fourth optical element 422*d* projects a coded light signal λ in a generally circular-shaped fourth lighting effect 424*d* onto ceiling 410 at a location above a third aisle 442*c*. A smart phone 430 carried through room 400 may be able to utilize lighting effects 424*a-d* detected on ceiling 410 to determine a location of smart phone 430 relative to aisles 442*a-d*.

Figure 5:
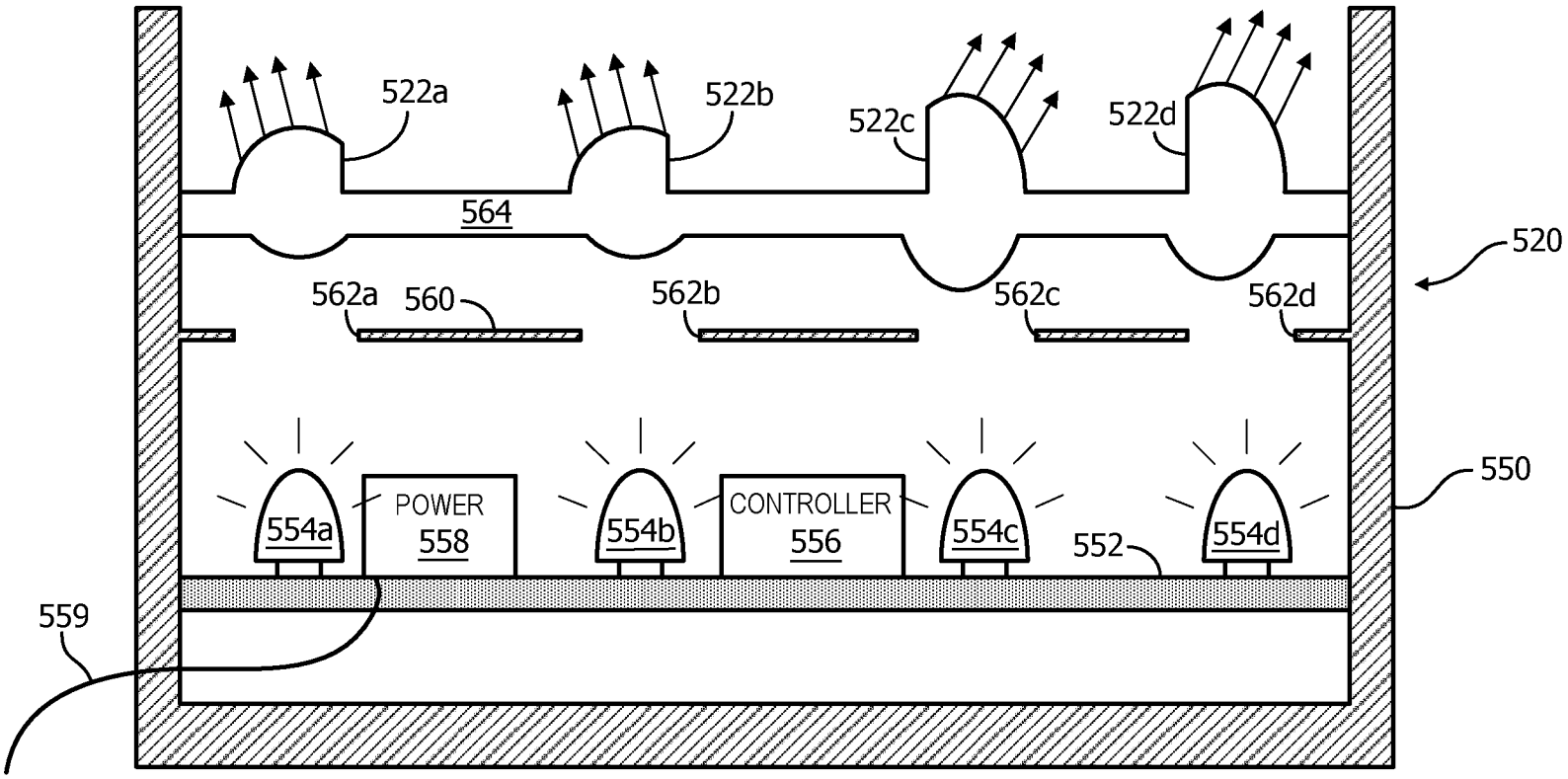
FIG. 5 is a cross-sectional illustration of an example lighting fixture configured with selected aspects of the present disclosure, in accordance with various embodiments.

FIG. 5 depicts, in cross section, an example lighting fixture 520 configured with selected aspects of the present disclosure. Lighting fixture 520 may include a housing 550 that contains a printed circuit board (PCB) 552 on which a plurality of LEDs 554*a-d* may be installed. A controller 556 and a power supply 558 may also be installed on PCB 552 to be operably coupled with plurality of LEDs 554*a-d*. A cord 559 may couple power supply 558 to a source of power (not shown), such as AC mains, etc.

As described above, controller 556 may be configured to selectively energize LEDs 554*a-d* so that light emitted from LEDs 554*a-d* has various lighting properties. For example, controller 556 may energize first LED 554*a* so that light it emits carries coded signal α. Controller 556 may energize second LED 554*b* so that light it emits carries coded signal β. Controller 556 may energize third LED 554*c* so that light it emits carries coded signal θ. Controller 556 may energize fourth LED 554*d* so that light it emits carries coded signal λ. In various embodiments, controller 556 may additionally or alternatively energize each of LEDs 554*a-d* to be a distinct hue or to have another lighting property detectable by a mobile computing device (e.g., smart phone 130, 230, 330, 430, etc.).

A mask 560 may be provided to define shapes of lighting effects created from light emitted by plurality of LEDs 554*a-d*. Mask 560 may define a plurality of apertures 562*a-d*, each which may shape light emitted from plurality of LEDs 554*a-d* into a particular shape. Any shape may be defined, including those shown in FIGS. 1-4, as well as other symmetrical and asymmetrical shapes.

In various embodiments, a plurality of optical elements 522*a-d* may be provided, similar to 122*a-d*, 222*a-d*, 322*a-d* and 422*a-d* described above. In various embodiments, plurality of optical elements 522*a-d* may be shaped to direct light emitted from plurality of LEDs-554*a-d* in various directions (as shown by the arrows in FIG. 5), e.g., towards various surfaces. Additionally or alternatively, in various embodiments, plurality of optical elements 522*a-d* may be shaped to shape light emitted from at least one of plurality of LEDs 554*a-d* into a symmetrically or asymmetrically-shaped projected light effect. In some embodiments, plurality of optical elements 522*a-d* may be integrally formed in an injection molded plastic cover plate 564, although this is not required and they may be formed separately in other embodiments.

In various embodiments, lighting fixtures configured with selected aspects of the present disclosure (e.g., 120, 220, 320, 420, 520) may be configured to selectively energize a plurality of LEDs (e.g., 554*a-d*) simultaneously and/or non-simultaneously. For instance, to save on power usage and/or wear and tear, controller 556 may only illuminate one of plurality of LEDs 554*a-d* at a time. Controller 556 may cycle through illuminating plurality of LEDs 554*a-d* quickly enough that a smart phone (e.g., 130, 230, 330, 430) within line of sight of the lighting effect for at least a brief period of time is likely going to be able to detect the projected lighting effect.

In some embodiments, controllers (e.g., 556) of lighting fixtures configured with selected aspects of the present disclosure (e.g., 120, 220, 320, 420, 520) may be configured to selectively energize a plurality of LEDs (e.g., 554*a-d*) so that each LED emits light carrying the same coded light signal. The lighting fixture may cause the emitted light to have different shapes, sizes, or hues. This enables a smart phone (e.g., 130, 230, 330, 430) to distinguish between the multiple lighting effects. Thus, for instance, a single lighting fixture may emit a particular coded light signal to identify an entire area, and to emit lighting effects of distinct shapes, hues, sizes, intensities, etc., to identify subsections of the area.

In various embodiments, controllers (e.g., 556) of lighting fixtures configured with selected aspects of the present disclosure (e.g., 120, 220, 320, 420, 520) may be configured to selectively energize a plurality of LEDs (e.g., 554*a-d*) so that the corresponding lighting effects have intensities that are completely or substantially imperceptible to a human eye. Smart phone cameras, particularly those that add multiple pixel values in a line to increase sensitivity, may be particularly suitable for detecting such low intensity lighting effects. In some cases, lighting effects may not be visible to the human eye, but still visible to a digital camera of a smart phone, because they are projected onto a surface of varying uniformity and/or color intensity, such as a shelf of goods. In some embodiments, controllers (e.g., 556) of lighting fixtures configured with selected aspects of the present disclosure (e.g., 120, 220, 320, 420, 520) may be configured to selectively energize a plurality of LEDs (e.g., 554*a-d*) so that the corresponding lighting effects have intensities that blend in with ambient or overall illumination of an environment.

Figure 6:
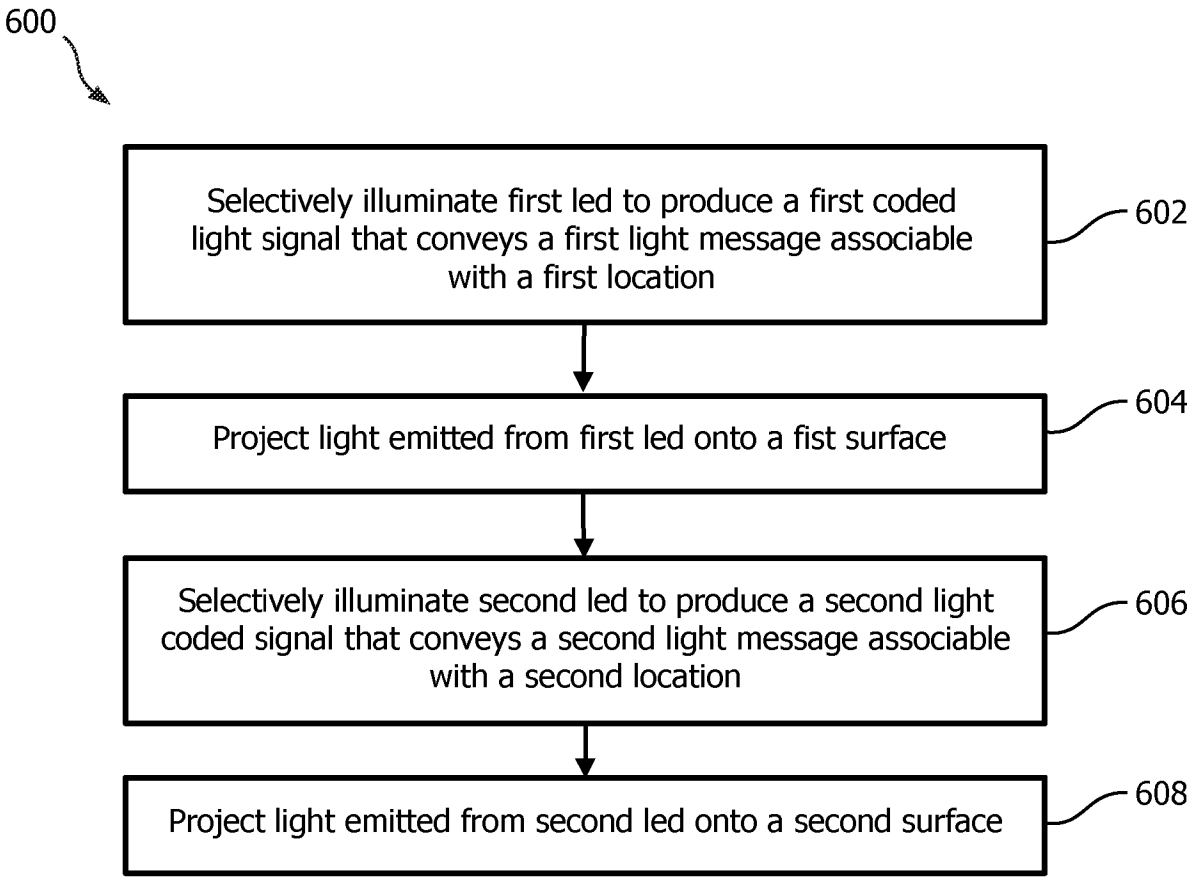
FIG. 6 depicts a method of using a lighting fixture configured with selected aspects of the present disclosure, in accordance with various embodiments.

Referring now to FIG. 6, an example method 600 is illustrated for selectively energizing a plurality of LEDs of a lighting fixture configured with selected aspects of the present disclosure (e.g., 120, 220, 320, 420, 520), in accordance with various embodiments. While these operations are shown in sequence, this is not meant to be limiting, and in various embodiments, these operations would occur contemporaneously and/or simultaneously. For instance, operations 602 and 604, as well as the operations at 606 and 608, would likely happen virtually simultaneously, as the light emitted from the LED would travel at the speed of light to the surface.

At block 602, a first of a plurality of LEDs of a lighting fixture (e.g., 554*a*) may be selectively energized, e.g., by controller 556, to produce a first coded light signal that conveys a first light message associable with a first location. At block 604, light emitted from the first LED may be projected, e.g., by one or more mask apertures (e.g., 562*a-d*) and/or optical elements (e.g., 522*a-d*), onto a first surface. For instance, in FIG. 4, lighting fixture 420 may project, from second optical element 422*b*, a second lighting effect 424*b* onto ceiling 410. Second lighting effect 424*b* may carry a coded light signal β that corresponds (e.g., via database cross referencing) with "AISLE ONE."

At block 606, a second of a plurality of LEDs of a lighting fixture (e.g., 554*b*) may be selectively energized, e.g., by controller 556, to produce a second coded light signal that conveys a second light message associable with a second location. At block 608, light emitted from the second LED may be projected, e.g., by one or more mask apertures (e.g., 562*a-d*) and/or optical elements (e.g., 522*a-d*), onto a second surface. For instance, in FIG. 4, lighting fixture 420 may project, from first optical element 422*a*, a first lighting effect 424*a* onto ceiling 410. First lighting effect 424*a* may carry a coded light signal α that corresponds (e.g., via database cross referencing) with "AISLE TWO."

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

Reference numerals appearing between parentheses in the claims, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A lighting fixture, comprising:

a housing;

at least two light-emitting diodes (LEDs) contained on or within the housing and configured to project at least two beams of light on one or more surfaces, the at least two beams of light creating respectively a first and a second spatially-limited lighting effect on the one or more surfaces;

a controller contained within the housing and operably coupled to the at least two LEDs and configured to selectively energize the at least two LEDs to cause the first and second spatially-limited lighting effects to carry at least two distinct coded light signals simultaneously, wherein the at least two projected spatially-limited lighting effects provide detectable locational data.

2. The lighting fixture of claim 1, wherein the at least two distinct light signals are conveyed at least in part by a plurality of distinct coded light signals carried by the at least two projected lighting effects.

3. The lighting fixture of claim 1, wherein the at least two distinct light signals are conveyed at least in part by a plurality of distinct hues of the at least two projected lighting effects.

4. The lighting fixture of claim 1, wherein the at least two distinct light signals are conveyed at least in part by a plurality of distinct shapes of the at least two projected lighting effects.

5. The lighting fixture of claim 1, further comprising at least two optical elements shaped to direct light emitted by the at least two LEDs onto one or more surfaces.

6. The lighting fixture of claim 5, wherein at least one of the at least two optical elements is configured to shape light emitted from at least one of the at least two LEDs into the asymmetrically-shaped projected light effect.

7. The lighting fixture of claim 5, wherein the at least two optical elements are shaped to direct light emitted by the at least two LEDs so that the at least two projected lighting effects are positioned to correspond with a plurality of aisles.

8. The lighting fixture of claim 1, further comprising a mask with at least two shaped apertures configured to define shapes of the at least two lighting effects.

9. The lighting fixture of claim 1, further comprising a general purpose light source mounted on or within the housing and configured to illuminate a space proximate the lighting fixture.

10. The lighting fixture of claim 1, wherein the housing is configured to be mounted on a wall or ceiling.

11. The lighting fixture of claim 1, wherein the at least two LEDs are configured to project the at least two lighting effects with an intensity selected to make the at least two lighting effects visually imperceptible to a human and detectable by an optical sensor of a mobile computing device.

12. The lighting fixture of claim 1, wherein the at least two distinct coded light signals are associable with a plurality of distinct locations.

13. A method, comprising:

selectively energizing, by a controller of a lighting fixture, a first of a plurality of light-emitting diodes (LEDs) of the lighting fixture to produce a first coded light signal that conveys a first light message associable with a first location, the first light message providing detectable locational data via emitted light;

projecting, by the lighting fixture, light emitted from the first LED onto a first surface;

selectively energizing, by the controller, a second of the plurality of LEDs of the lighting fixture to produce a second coded light signal that conveys a second light message associable with a second location distinct from the first location, the second light message providing detectable locational data via emitted light; and projecting, by the lighting fixture, light emitted from the second LED onto the first surface or a second surface.

14. The method of claim 13, wherein projecting the light emitted from the first LED comprises projecting the light emitted from the first LED onto a portion of a ceiling above a first aisle of a plurality of parallel aisles, and wherein projecting the light emitted from the second LED comprises projecting the light emitted from the second LED onto a portion of the ceiling above a second aisle of the plurality of parallel aisles.

15. The method of claim 13, wherein projecting the light emitted from the first LED comprises projecting the light emitted from the first LED onto a floor of a first aisle of a plurality of parallel aisles.

16. The method of claim 15, wherein projecting the light emitted from the second LED comprises projecting the light emitted from the second LED onto a floor of a second aisle of a plurality of parallel aisles.

17. The method of claim 15, wherein projecting the light emitted from the second LED comprises projecting the light emitted from the second LED onto a shelf of a second aisle of the plurality of parallel aisles.

18. A lighting fixture, comprising:

a housing;

first and second light-emitting diodes (LEDs) contained within the housing;

first and second optical elements mounted on the housing and configured to direct light emitted from the first and second LEDs onto one or more surfaces; and a controller operably coupled to the first and second LEDs and configured to:

illuminate the first LED to produce a first coded light signal that conveys a first light message associable with a first location, the first light message providing detectable locational data via emitted light; and illuminate the second LED to produce a second coded light signal that conveys a second light message associable with a second location distinct from the first location, the second light message providing detectable locational data via emitted light.

19. The lighting fixture of claim 18, further comprising a mask with first and second shaped apertures configured to define shapes of first and second projected lighting effects created by the first and second LEDs, respectively.

20. The lighting fixture of claim 19, wherein the first and second shaped apertures are configured to define first and second distinct shapes of the first and second projected lighting effects.

* * * * *